United States Patent [19]

Elliston

[11] 4,128,229

[45] Dec. 5, 1978

[54] HOIST APPARATUS WITH DUAL MAST STRUCTURE AND COMPOUND POWER TRANSMISSION SYSTEM

[75] Inventor: Thomas L. Elliston, Fort Worth, Tex.

[73] Assignee: Hydra-Rig, Inc., Fort Worth, Tex.

[21] Appl. No.: 852,554

[22] Filed: Nov. 17, 1977

[51] Int. Cl.[2] ..... B66C 23/60

[52] U.S. Cl. ..... 254/139; 254/189; 187/26; 173/147

[58] Field of Search ..... 254/139.1, 139, 143, 254/144, 148, 188, 189, 190 B; 187/23, 20, 26, 81, 95; 173/147, 148, 149; 214/394, 392, 175; 188/75 R; 52/121, 122; 212/41, 40 B

[56] References Cited

U.S. PATENT DOCUMENTS

| | | | |
|---|---|---|---|
| 1,928,958 | 10/1933 | Young et al. | 254/190 B |
| 2,239,493 | 4/1941 | Nichols | 254/188 |
| 2,766,009 | 10/1956 | Wilson | 254/190 B |
| 3,792,836 | 2/1974 | Bender | 254/139 |
| 3,960,360 | 6/1976 | Elliston | 254/139.1 |
| 4,005,851 | 2/1977 | Plote | 254/139 |

*Primary Examiner*—Trygve M. Blix
*Assistant Examiner*—Kenneth W. Noland
*Attorney, Agent, or Firm*—Hubbard, Thurman, Turner, Tucker & Glaser

[57] ABSTRACT

A hoist rig for lifting and lowering a pipestring is disclosed. The rig includes first and second vertical mast structures, a traveling block for engaging and transporting the pipestring, and a compound power transmission system for raising and lowering the traveling block and pipestring. The compound power transmission system includes traveling sheaves mounted on the extensible portion of the linear actuators, crown sheaves mounted on the upper ends of the mast structures, and first and second cable systems having end portions secured to the traveling block and having intermediate portions disposed in cooperative reeved engagement with the traveling sheaves and crown sheaves of each mast structure for displacing the traveling block in response to extension or retraction of the linear actuators. In a preferred embodiment, at least one additional linear actuator is secured to each mast structure, the piston element of each actuator being secured to the upper end of the mast structures, and the extendable housing elements being mechanically coupled to one another for a concurrent movement along the mast structures. In this preferred arrangement, at least one additional array of crown sheaves and traveling sheaves is provided and at least one additional independent cable system is cooperatively engaged with the additional array of sheaves to displace the traveling block in response to operation of the linear actuators.

21 Claims, 2 Drawing Figures

HOIST APPARATUS WITH DUAL MAST STRUCTURE AND COMPOUND POWER TRANSMISSION SYSTEM

BACKGROUND OF THE INVENTION

1. Field of the Invention

The present invention relates to apparatus for raising and lowering heavy equipment, and more particularly, the invention relates to a hoist rig for launching and recovering a pipestring in the operation of a deep ocean mining vessel.

2. Description of the Prior Art

The potential of the ocean for supplying important and basic raw materials is generally recognized. Mining operations for sand, gravel, shell and other materials from continental shelf deposits are presently being performed by dredging techniques. On the ocean floor in deeper waters are vast quantities of mineral deposits. Among these deposits are mineral concentrations spread over large areas of the ocean floor in the form of nodules. Existence of nodules on the ocean bottom has been known for many years and are believed to be formed over aeons of time due to the precipitation of the mineral substances out of the seawater. These nodules are known to consist essentially of iron oxide, manganese oxide, copper, cobalt and nickel, and are generally found in the deep areas of the sea where the floor is relatively hard and flat. The areas in which the nodules are presently known to exist in sufficient quantities to sustain a profitable mining operation are found generally more than 200 miles off shore and at depths of up to 18,000 feet and more.

Among the numerous systems which have been conceived for the recovery of nudules from the ocean floor is the hydraulic system which generally consists of a pipestring which is suspended from a floating platform or vessel. The system includes a gathering head which is designed to collect and winnow the nodules from the ocean floor sediments and transport them through the pipestring. Means are provided for causing the water inside the pipestring to flow upward with sufficient velocity to draw the nodules into the system and transport them to the surface.

One of the major problems associated with this mining method is the provision of hoist means for launching and recovering the pipestring. The load of the pipestring for working in depths up to 18,000 feet may exceed 5,000 kips. Since the design load of the hoist apparatus must include a conservative safety factor, it will be appreciated that a hoist rig for handling the pipestring in such deep ocean mining operations must be capable of lifting unusually large loads. Such large loads exceed the load lifting capability of conventional hoist apparatus. Generally, the conventional hoist rigs include a single derrick or mast support and one or more cables reeved on sheave assemblies. The theoretical limit of the magnitude of the load which can be lifted by such an arrangement depends upon the structural strength of the mast structure and the tension rating of the cables which reeved around the support sheaves. The tension strength of the cables is generally proportional to the diameter of the cables. However, as the diameter of the cables is increased to lift heavier loads, the flexibility of the cables decreases. The cables, of course, must be strong enough to support the load of the pipestring and must also be flexible enough to permit the traveling block, which engages the pipestring, to be transported smoothly and rapidly for efficient operation during launching or recovery operations.

Recent improvements in the construction of mast structures has greatly increased the maximum load bearing capability of a single mast structure. For example, an improved mast structure is disclosed and claimed in U.S. Pat. No. 3,960,360 to Thomas L. Elliston. The dynamic load efficiency of that mast structure is substantially greater than conventional mast structures of comparable size and has performed entirely satisfactorily for lifting loads in the intermediate range. The maximum load bearing capability of such a structure can be designed to match the load bearing capability of multiple runs of power transmission cables which are reeved in sheaves supported by the mast structure. However, because of the flexibility constraint discussed above, the diameter of the power transmission cable cannot be increased substantially without compromising the efficiency and execution of launching and recovery operations. Furthermore, the number of power transmission cable runs is also limited because of the relatively small amount of cable running space available along a single mast structure. It is, therefore, a principal object of the present invention to provide an improved hoist rig for accommodating the substantially greater load handling requirements associated with the launching and recovering of pipestrings in deep ocean mining operations.

Examples of prior art approaches for improving the load handling ability of a hoist rig having sheaves and cables reeved in the sheaves are disclosed in the following U.S. Pat. Nos. 1,928,958 to a Young et al.; 2,239,493 to Nichols; 2,766,009 to Wilson; and 3,719,238 to Campbell et al.

SUMMARY OF THE INVENTION

A hoist rig having substantially increased load handling capability constructed according to the present invention comprises generally first and second mast structures and first and second independent power transmission systems cooperatively associated in a compound arrangement which permits unrestricted movement of a traveling block through a pipe handling zone and which permits the load imposed by a pipestring engaged by the traveling block to be divided substantially equally among multiple cables which are reeved in parallel around sheaves mounted on each of the mast structures. Each independent power transmission system includes an extensible linear actuator secured to each mast structure having a section extendable along each mast. The essential elements of the power transmission system are crown sheaves secured to the upper end of each mast structure, traveling sheaves secured to the extendable portion of the linear actuator of each mast structure, and first and second independent cable assemblies disposed in reeved engagement with the crown sheaves and traveling sheaves for transmitting the lifting force developed by operation of the linear actuators to lift a pipestring load engaged by the traveling block. In a preferred embodiment, each mast is provided with a plurality of linear actuators whose extendable portions are mechanically coupled together, and a corresponding number of independent arrays of traveling sheaves and crown sheaves are also provided for engagement by a corresponding number of multiple cable systems which are reeved in parallel with each other for providing increased load handling capability without compromising the efficiency or execution of launching and recovery operations.

The foregoing and other objects, advantages and features of the invention will hereinafter appear, and for purposes of illustration, but not of limitation, an exemplary embodiment of the subject invention is shown in the various views of the appended drawing.

DETAILED DESCRIPTION

Figure 1:
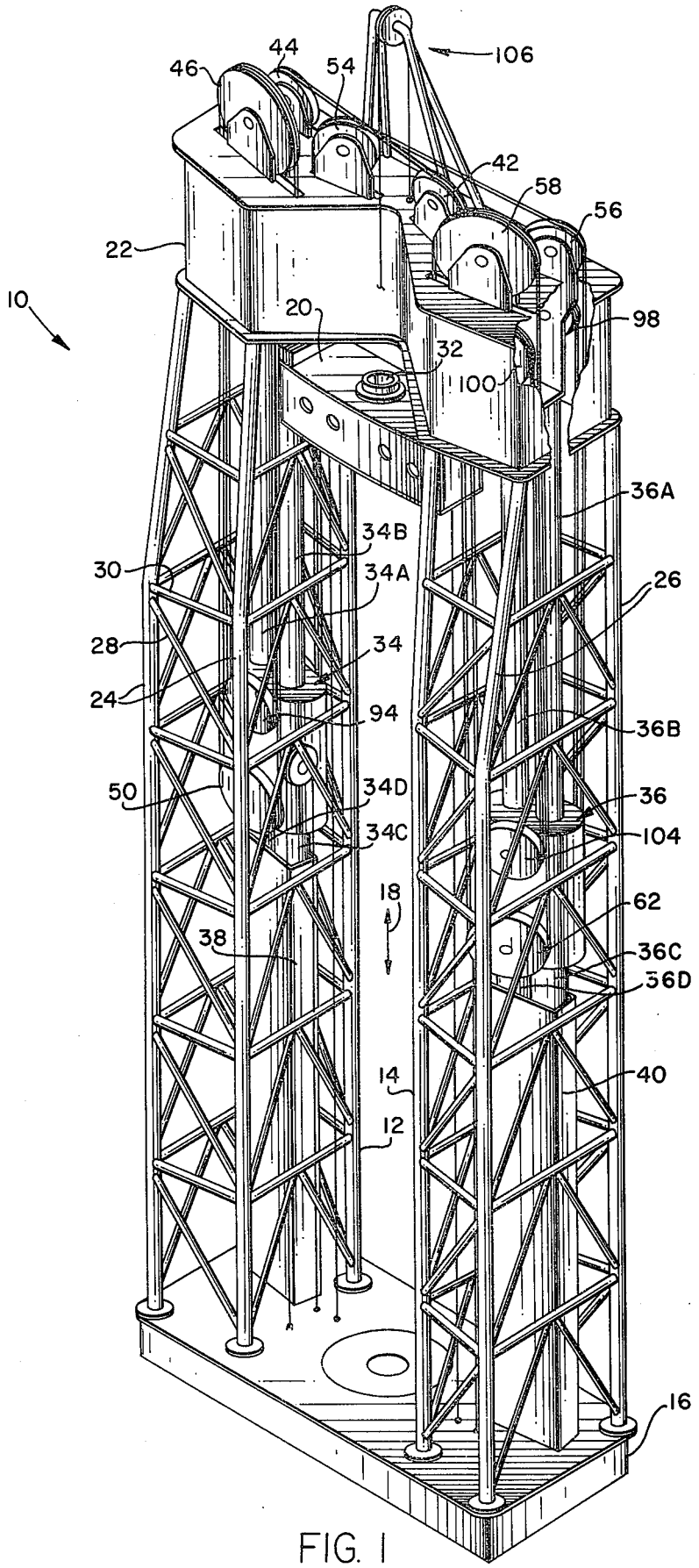
FIG. 1 is an isometric view of the mast structure of the present invention; and, FIG. 2 is an isometric view which ilustrates the arrangement of sheaves and reeving of cables for the mast structure shown in FIG. 1.

Referring now to the drawing, and more particularly to FIG. 1, a hoist rig constructed according to the teachings of the present invention is designated by the numeral 10 and is shown having a first upstanding mast structure 12 and a second upstanding mast structure 14 laterally spaced from one another on a base platform 16. The base platform 16 may be part of the rig structure for a deep mining vessel, or it may comprise a part of the operating floor of an oil production rig. The hoist rig 10 is specifically constructed for handling unusually heavy loads such as are imposed by vertical pipestrings. Thus the hoist rig of the invention can be used to good advantage in deep ocean mining operations on the high seas, and in oil production operations on the high seas or on land.

The first and second mast structures 12, 14 project perpendicular to the base platform 16 and are laterally spaced apart to define a pipe handling zone 18 through which a traveling block 20 is transported during launching and recovery operations. The upper ends of the first and second mast structures are mechanically interconnected by a crown block 22 which improves the mechanical stability of the mast structures and which also serves to support crown block sheaves in a manner to be disclosed hereinafter.

The first and second mast structures 12, 14 each comprise groups of four tubular upstanding members 24, 26, respectively, which are generally arranged at corners of a square on laterally opposite sides of the base platform 16 and are rigidly secured thereto. Structural cross bracing members 30 are provided to ensure rigidity of each mast structure. For increased structural strength, the tubular members 24, 26 of each structure 12, 14 may be pressurized with hydraulic fluid according to the teachings of U.S. Pat. No. 3,960,360 to Thomas L. Elliston, which is hereby incorporated by reference.

The traveling block 20 is vertically guided through the pipe handling zone 18 by cable means which will be fully described hereinafter. The traveling block 20 includes latching means 32 which cooperates with an elevator block (not shown) to facilitate pipe stabbing and removal during launching and recovery operations. The power to raise and lower the traveling block 20 is provided by first and second extensible linear actuating means 34, 36 which are enclosed by the tubular members 24, 26 of each mast structure. Each linear actuating means preferably comprises a hydraulic actuator of the type including a mutually extendable piston and housing member. It is essential that at least one linear actuator be provided for each mast structure. However, for increased load handling capability, it is preferred that a plurality of linear actuators be provided for each mast structure and that their extendable portions be mechanically coupled together for concurrent movement so that their output forces are summed together.

In FIG. 1, each mast structure is provided with a pair of hydraulic actuators each having piston portions 34A, 34B secured to the upper end of the first mast structure 12, and piston elements 36A, 36B secured to the upper end of the second mast structure 14. Each linear actuator is also provided with housing cylinder portions 34C, 34D and 36C, 36D respectively, which are extendable along each mast structure. The piston rod elements 34A, B and 36A, B are secured to the top of the corresponding mast structures so that they cannot move. Hydraulic fluid is pumped through passages in the piston rod elements and is discharged inside of the corresponding cylinders. This causes the cylinders to move either up or down, while the pistons remain stationary. To ensure stable vertical movement, the cylinders 34C, D and 36C, D are each arranged to travel through cylinder guides 38, 40 respectively.

The traveling block 20 includes a slip bowl and latching means 32 for engaging a section of pipe to be stabbed into a pipestring (not shown) during a launching operation, or to be removed from the pipestring during a recovery operation. The lifting force provided by operation of the linear actuators 34, 36 for transporting the traveling block 20 through the pipe handling zone 18 is transmitted to the traveling block 20 by a compound sheave and cable assembly which may best be understood by reference to FIG. 2 of the drawing.

Figure 2:
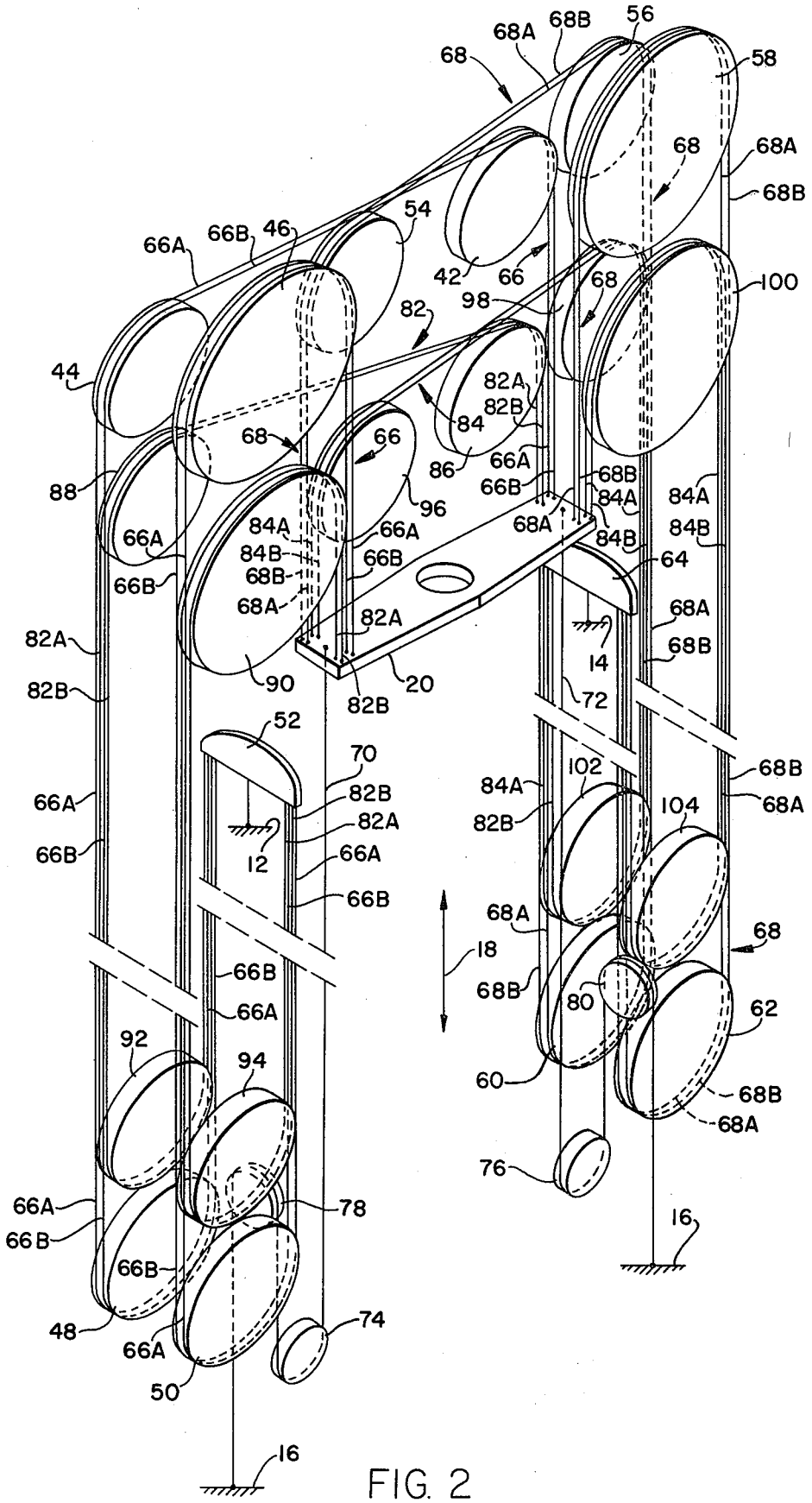

A preferred embodiment of a compound power transmission assembly is shown in FIG. 2 which includes first and second independent compound sheave and cable assemblies which are mechanically coupld in parallel with each other. The components of the first independent compound power transmission assembly will now be described. The principal components of the first independent system are a first array a sheaves disposed on the crown block, upper ends of the first and second mast structures 12, 14 and on the extendable cylinder portions of the first and second linear actuators 34, 36. The sheaves which comprise the first independent array are as follows: a first crown block sheave 42, first and second crown sheaves 44, 46, which are secured to the upper end of the first mast structure 12, first and second traveling sheaves 48, 50; and, an equalizing shoe 52 also secured to the first mast structure 12. The remaining sheaves of the first independent array are similarly disposed about the crown block 22 and the second mast structure 14. These sheaves are the second crown block sheave 54, first and second crown sheaves 56, 58 mounted on the upper end of the second mast structure 14; first and second traveling sheave 60, 62 mounted on the extendable cylinder portion of the second linear actuator 36; and a second equalizing shoe 64 secured to the second mast structure 14.

The sheaves of the first independent array are reeved in a differntial arrangement known as a double purchase which multiplies the maximum effective stroke of the hydraulic actuators thereby minimizing the height of the mast structures. The reeving is accomplished with first and second independent groups of cables 66, 68. The first and second cable groups 66, 68 comprise equal numbers of cables with each group containing at least one cable. A preferred embodiment is illustrated in FIG. 2 in which each of the cable groups include first and second cables 66A, B and 68A, B respectively. The terminal end portions of the cable 66A, B are secured at laterally opposite sides of the traveling block 20 and intermediate portions of the cable 66A, 66B are successively reeved around the first crown block sheave 42, the first crown sheave 44, the first traveling sheave 48, the equalizing shoe 52, the traveling sheave 50, and finally the second crown sheave 46. The end portions of the cable 68A, 68B are also secured to the traveling block 20 at laterally opposite locations on the traveling block and are spaced from the end portions of the cables 66A, B. Intermediate portions of the cable 68A, B are successively reeved around the second crown block sheave 54, the first crown sheave 56 secured to the upper end of the second mast structure 14, the first traveling sheave 60 mounted on the extendable cylinder portion of the second linear actuator 36, the second equalizing shoe 64, the second traveling sheave 62, and finally around the second crown sheave 58 of the second mast structure 14.

This compound sheave and cable arrangement permits unrestricted movement of the traveling block 20 through the pipe handling zone 18. The traveling block 20 is, in effect, suspended from points on the peripheries of the crown sheaves 46, 58 and crown block sheaves 42, 54 so that the traveling block 20 travels along parallel vertical runs of the first and second cable groups 66, 68 at four equidistant terminal points relative to the center of gravity of the traveling block 20. According to this arrangement, the terminal portions of the hoist cables are secured to the traveling block at locations which are substantially equidistant from the center of gravity of the traveling block 20, with the terminal portions of hoist cables of the first cable group 66 located equidistant from the corresponding terminal portions of the hoist cables of the second cable group 68. The advantage of this arrangement is that the traveling block 20 is supported by several relatively flexible hoist cables each of which support only a fraction of the working load. Additional cables can be added to each of the first and second cable groups 66, 68 to increase the load handling capability of the hoist rig 10 without interfering with pipe handling operations in the handling zone 18. The number of cables in each cable group will depend upon design load considerations and should be consistent with the dynamic load rating of the mast structure and should provide an adequate line safety factor. A suitable cable type is Mac Whyte 1¾ inch diameter 7-Flex having a breaking strength rating of 304,000 pounds.

First and second drawdown cables 70, 72 are secured to the traveling block 20 and are reeved around base sheaves 74, 76 and first and second drawdown traveling sheaves 78, 80 and are connected to the base platform structure 16 or to some other foundation structure. This drawdown arrangement provides that the traveling block 20, which is lifted vertically by the first and second cable groups 66, 68 during extension of the cylinder housings of the linear actuators 34, 36, is drawn down vertically toward the base platform during retraction of the linear actuators.

According to the preferred embodiment shown in FIG. 1 of the drawing, two linear actuators are disposed within each of the mast structures 14, 16 to increase the load handling capability of the hoist rig. 10. In this arrangement, it is preferred that additional hoist cables be provided instead of providing hoist cables of increased diameter for the first and second cable groups 66, 68. Accordingly, an independent group of hoist cables 82, 84 are provided and a second independent array of sheaves is also provided. The sheaves of the additional independent array are disposed substantially in coplanar arrangement with corresponding sheaves of the original independent array and are stacked in tandem relation to the corresponding sheaves of the first independent array of sheaves. The sheaves of the second independent array are identified as follows: a first crown block sheave 86 disposed in coplanar relation and directly beneath the first crown block sheave 42; first and second crown sheaves 88, 90 secured to the upper end of the first mast structure and below the first and second crown sheaves 44, 46; and, first and second traveling sheaves 92, 94 secured to the extendable cylinder portion of the linear actuator 34 of the first mast structure 12. A similar group of sheaves including a second crown block sheave 96, first and second crown sheaves 98, 100, and first and second traveling sheaves 102, 104 are also secured in coplanar, tandem relation along the mast structure 14.

A handling line assembly 106 is secured to the crown block 22 for handling and transporting pipe sections which have been removed from the pipestring or which are to be connected to the pipestring during recovery and launching operations.

Although the invention as disclosed in the foregoing description of a preferred embodiment has particular utility for launching and recovering a pipestring in the operation of a deep ocean mining vessel, those skilled in the art will appreciate that the apparatus of the invention may be used to good advantage in other fields of application: for example, the apparatus of the invention has utility for lifting and lowering pipe or tubing in the operation of a production oil well. It should also be understood that various changes, substitutions, and alterations can be made without departing from the spirit and scope of the invention as defined by the appended claims.

What is claimed is:

1. A hoist rig for lifting a load comprising:

a first mast structure for bearing part of the weight of the load, a second mast structure for bearing part of the weight of the load, the second mast structure being laterally spaced from the first mast structure thereby defining a load lifting zone;

load engaging means disposed intermediate the first and second mast structures for transporting the load through the load lifting zone;

a power transmission system for raising and lowering a load transported by the load engaging means, the system including first and second cable systems secured to the load engaging means, first and second traveling sheaves mounted for movement along the first and second mast structures, respectively, and engaging the first and second cable systems, respectively, whereby the load engaging means moves in response to movement of the traveling sheaves; and, first and second extensible linear actuator means each having rod and housing elements, one of the elements of the first and second actuator means being secured to the upper end of the first and second mast structures, respectively, and the other one of the elements carrying the first and second traveling sheaves of the first and second mast structures, respectively, whereby the load engaging means is displaced through the load lifting zone in response to extension of the rod and housing elements relative to each other and whereby part of the load force imposed on the first and second mast structures is opposed by the reaction load forces produced by the first and second actuator means of the first and second mast structures in response to extension of the rod and housing elements relative to each other.

2. The hoist rig as defined in claim 1 wherein the rod element of each linear actuator is secured to the upper end of the associated mast structure, the housing element being extendable along the rod element and carrying the traveling sheaves.

3. Hoist apparatus for lifting a length of pipe comprising:

a base platform;

a first mast structure secured to the base platform and projecting vertically therefrom;

a second mast structure secured to the base platform and projecting vertically therefrom, the second mast structure being laterally spaced from the first mast structure thereby defining a vertically extending pipe handling zone intermediate the first and second mast structures;

crown sheave means mounted on the upper end of the first and second mast structures;

traveling sheave means mounted for vertical movement along each of the first and second mast structures;

a traveling block disposed intermediate the first and second mast structures for movement through the pipe handling zone, a first plurality of hydraulic actuators disposed intermediate the traveling sheave means and the upper end of the first mast structure, each of the hydraulic actuators including a piston rod and a cylinder, the piston rods being mechanically secured to the upper end of the first mast structure, and the cylinders being mechanically coupled to each other and to the traveling sheave means;

a second plurality of hydraulic actuators disposed intermediate the traveling sheave means and the upper end of the second mast structure, each of the hydraulic actuators including a piston rod and a cylinder, the piston rod of each actuator being secured to the upper end of the second mast structure, and the cylinders being mechanically coupled to each other and to the traveling sheave means; and, cable means having end portions secured to the traveling block and intermediate portions in cooperative reeved engagement with the traveling sheave means and crown sheave means of each mast structure for displacing the traveling block vertically through the traveling zone in a first vertical direction in response to movement of the cylinders in extension along the piston rods.

4. The hoist apparatus as defined in claim 3, further including:

base sheave means secured to the base platform, and, second cable means having end portions secured to the traveling block and to the base platform and having intermediate portions disposed in cooperative reeved engagement with the traveling sheave means of at least one of the mast structures and with the base sheave means for displacing the traveling block vertically through the traveling zone in a direction to the first direction in response to movement of the cylinders in retraction along the piston rods.

5. The hoist apparatus as defined in claim 3, further including:

a first cylinder guide secured to the base platform and projecting vertically around the cylinders of the first plurality of hydraulic actuators; and, a second cylinder guide secured to the base platform and projecting vertically around the cylinders of the second plurality of hydraulic actuators.

6. Hoist apparatus comprising:

a first mast structure;

a second mast structure laterally spaced from the first mast structure thereby defining a vertically extending pipe handling zone intermediate the first and second mast structures;

a crown block interconnecting the upper ends of the first and second mast structures;

a traveling block disposed beneath the crown block intermediate the first and second mast structures for movement through the pipe handling zone;

crown sheave means mounted on the crown block and on the upper end of each mast structure;

traveling sheave means mounted for movement along each of the mast structures;

a first linear actuator interconnecting the upper end of the first mast structure and the traveling sheave means of the first mast structure for applying a displacing force between the upper end of the first mast structure and the traveling sheave means thereof;

a second linear actuator interconnecting the upper end of the second mast structure and the traveling sheave means of the second mast structure for applying a displacing force between the upper end of the second mast structure and the traveling sheave means thereof; and, cable means having end portions secured to the traveling block and intermediate portions disposed in reeved engagement with the traveling sheave means and with the crown sheave means for transmitting the displacing forces to the traveling block.

7. The hoist apparatus as defined in claim 6 wherein the first and second linear actuators each comprise a hydraulic actuator having a cylinder and a piston, the piston of the first hydraulic actuator being connected to the upper end of the first mast structure and the cylinder thereof being connected to the traveling sheave means of the first mast structure, the piston of the second hydraulic actuator being connected to the upper end of the second mast structure and the cylinder thereof being connected to the traveling sheave means of the second mast structure.

8. The hoist apparatus as defined in claim 6 wherin the first and second linear actuators each comprise a cluster of hydraulic actuators, each hydraulic actuator having a cylinder and a piston, each piston of the first cluster of hydraulic actuators being connected to the upper end of the first mast structure and each cylinder thereof being connected to each other and to the traveling sheave means of the first mast structure, each piston of the second cluster of hydraulic actuators being connected to the upper end of the second mast structure and each cylinder thereof being connected to each other and to the traveling sheave means of the second mast structure.

9. The hoist apparatus as defined in claim 6 wherein the traveling sheave means comprises an equal number of sheaves disposed on opposite sides of the linear actuator of each mast structure, the crown sheave means comprising a corresponding number of sheaves disposed on opposite sides of the upper part of the mast structure to which the linear actuator is attached.

10. The hoist apparatus as defined in claim 6, the crown sheave means comprising:

first and second crown sheaves mounted on the upper end of the first mast structure;

first and second crown sheaves mounted on the upper end of the second mast structure;

first and second crown sheaves mounted on the crown block at first and second laterally spaced positions intermediate the first and second mast structures; and, the traveling sheave means comprising:

first and second traveling sheaves mounted for movement along the first mast structure;

first and second traveling sheaves mounted for movement along the second mast structure; and, the cable means comprising:

a first cable having first and second end portions secured to the traveling block at first and second lateraly spaced positions thereon, intermediate portions of the first cable being reeved aroung the first crown sheave mounted on the crown block at the first laterally spaced crown block position intermediate the first and second mast structures, thereafter reeved around the first crown sheave mounted on the upper end of the first mast structure, thereafter being reeved around the first traveling sheave of the first mast structure, thereafter being reeved around the second traveling sheave of the first mast structure, and thereafter being reeved around the second crown sheave of the first mast structure; and, a second cable having first and second end portions secured to the traveling block at third and fourth laterally spaced positions thereon, intermediate portions of the second cable being reeved around the second crown sheave mounted on the crown block at the second laterally spaced crown block position intermediate the first and second mast structures, thereafter being reeved around the first crown sheave mounted on the upper end of the second mast structure, thereafter being reeved around the first traveling sheave of the second mast structure, thereafter being reeved around the second traveling sheave of the second mast structure, and thereafter being reeved around the second crown sheave of the second mast structure.

11. The hoist apparatus as defined in claim 10, further including first and second equalizing means secured to the first and second mast structures, respectively, the first cable being reeved around the first equalizing means after being reeved around the first traveling sheave and before being reeved around the second traveling sheave of the first mast structure, the second cable being reeved around the second equalizing means after being reeved around the first traveling sheave and before being reeved around the second traveling sheave of the second mast structure.

12. The hoist apparatus as defined in claim 10, the cable means further comprising at least one additional cable reeved in parallel with the first cable, and at least one additional cable reeved in parallel with the second cable, the first and second end portions of the additional cables being secured to the traveling block at positions adjacent to the end portions of the first and second cables, respectively.

13. The hoist apparatus as defined in claim 6, the crown sheave means and traveling sheave means in combination comprising a plurality of independent arrays of crown sheaves and traveling sheaves, the cable means including a corresponding number of independent cable systems, one of the independent cable systems being disposed in reeved engagement with the traveling sheaves and crown sheaves of each independent array, the independent cable systems being cooperatively disposed in relation to each other to displace the traveling block in response to operation of the linear actuators.

14. The hoist apparatus as defined in claim 13, each independent array of crown sheaves and traveling sheaves comprising:

first and second crown sheaves mounted on the upper end of the first mast structure;

first and second crown sheaves mounted on the upper end of the second mast structure;

first and second crown sheaves mounted on the crown block at first and second spaced positions, respectively, intermediate the first and second mast structures;

first and second traveling sheaves mounted for movement along the first mast structure; and first and second traveling sheaves mounted for movement along the second mast structure.

15. The hoist apparatus as defined in claim 14, each independent cable system including first and second groups of cables, the number of cables in each group being the same, intermediate portions of each cable of the first cable group of each independent cable system being reeved successively around the first intermediate crown sheave, the first crown sheave mounted on the upper end of the first mast structure, the first traveling sheave of the first mast structure, the second traveling sheave of the first mast structure, and finally around the second crown sheave mounted on the upper end of the first mast structure, the end portions of each cable in the first cable group being secured to the traveling block; and, intermediate portions of each cable in the second cable group in each independent cable system being successively reeved around the second intermediate crown sheave, the first crown sheave mounted on the upper end of the second mast structure, the first traveling sheave of the second mast structure, the second traveling sheave of the second mast structure, and finally around the second crown sheave mounted on the upper end of the second mast structure, the end portions of each cable in the second cable group being secured to the traveling block.

16. The hoist apparatus as defined in claim 15, further including first and second equalizing means secured to the first and second mast structures, respectively, an intermediate portion of each cable of the first cable group of each independent cable system being reeved around the first equalizing means after being reeved around the first traveling sheave of the first mast structure and of the associated independent array and before being reeved around the second traveling sheave thereof, and an intermediate portion of each cable of the second cable group of each independent cable system being reeved around the second equalizing means after being reeved around the first traveling sheave of the second mast structure and of the same independent array and before being reeved around the second traveling sheave thereof.

17. Hoist apparatus comprising:

a first vertical mast structure;

a second vertical mast structure;

a base platform interconnecting the lower end portions of the first and second mast structures;

a crown block interconnecting the upper end portions of the first and second mast structures;

a traveling block disposed for vertical travel intermediate the first and second mast structures;

a first linear actuator secured to the first mast structure and having a section extendable along the mast;

a second linear actuator secured to the second mast structure and having a section extendable along the mast;

first traveling sheave means including a pair of sheaves mounted on the opposite sides of the extendable section of the first linear actuator;

second traveling sheave means including a pair of sheaves mounted on the opposite sides of the extendable section of the second linear actuator;

drawdown traveling sheave means including a sheve mounted on each of the extendable sections of the first and second linear actuators, respectively;

first crown sheave means including a pair of sheaves mounted on the first mast structure, the sheaves being balanced relative to the longitudinal axis of the first linear actuator;

second crown sheave means including a pair of sheaves mounted on opposite sides of the second mast structure, the sheaves being balanced relative to the longitudinal axis of the second linear actuator;

crown block sheave means including a pair of sheaves mounted on the crown block at laterally spaced positions intermediate the first and second mast structures;

first and second equalizing means secured to the first and second mast structures at a predetermined elevation with respect to the base platform, respectively;

base sheave means including a pair of sheaves mounted on the base platform beneath the traveling block;

first power transmission means including a continuous cable having first and second terminal portions secured to the traveling block and having a first intermediate portion extending from the first terminal portion reeved successively around a selected one of the crown block sheaves of the crown block, around one of the crown sheaves of the first mast structure, and around one of the traveling sheaves mounted on the first linear actuator, and having a second intermediate portion extending from the second terminal portion reeved successively around the remaining crown sheave and traveling sheave of the first mast structure in parallel with the first intermediate portion, the union of the first and second intermediate cable portions being reeved around the first equalizing means thereby defining a first cable purchase;

second power transmission means including a continuous cable having first and second terminal portions secured to the traveling block and having a first intermediate portion extending from the first terminal portion reeved successively around the remaining one of the crown block sheaves, around a selected one of the crown sheaves of the second mast structure, the around one of the traveling sheaves mounted on the second linear actuator, and having a second intermediate portion extending from the second terminal portion reeved successively around the remaining crown sheave and traveling sheave of the second mast structure in parallel with the first intermediate portion, the union of the first and second intermediate cable portions being reeved around the second equilizing means thereby defining a second cable purchase; and, drawdown cable means including first and second drawdown cables each having a first end portion connected to the traveling block, a second end portion secured to the base platform, and an intermediate portion reeved successively around a selected one of the base sheaves and the drawdown traveling sheave of the first and second mast structures, respectively.

18. The hoist apparatus as defined in claim 17, further including:

at least one additional cable having first and second terminal portions secured to the traveling block and intermediate portions reeved in parallel with the continuous cable of the first power transmission means; and, at least one additional cable having first and second terminal portions secured to the traveling block and intermediate portions reeved in parallel with the continuous cable of the second power transmission means.

19. The hoist apparatus as defined in claim 17, wherein the terminal portions of the cables of the first and second power transmission means are secured to the traveling block at locations which are substantially equidistant from the center of gravity of the traveling block, the locations of the first and second terminal portions of each cable being disposed on laterally opposite sides thereof, the terminal portions of the first power transmission means being equidistant from the corresponding terminal portions of the second power transmission means.

20. The hoist apparatus as defined in claim 17 wherein the first and second linear actuators each comprise a piston rod and an extendable housing, the piston rod of each actuator being secured to the upper end of the corresponding mast structure, and the extendable housing of each actuator being mounted for vertical movement along the corresponding mast structure and carrying the associated traveling sheave means.

21. The hoist apparatus as defined in claim 17, further including:

at least one additional linear actuator secured to the first structure having a section extendable along the mast, the extendable sections of the first and additional actuators being mechanically coupled to one another for concurrent movement along the first mast structure;

at least one additional linear actuator secured to the second mast structure having a section extendable along the mast, the extendable sections of the second and additional actuators being mechanically coupled to one another for concurrent movement along the second mast structure;

the first and second traveling sheave means each including at least one additional pair of sheaves, corresponding sheaves of the first and additional pairs being disposed in coplanar, stacked relation and secured to opposite sides of the mechanically coupled extendable sections;

the first and second crown sheave means each including at least one additional pair of sheaves, corresponding sheaves of the first and additional pairs being disposed in coplanar, stacked relation on each of the first and second mast structures; and, third and fourth power transmission means each including a continuous cable having first and second terminal portions secured to the traveling block and having intermediate portions seccessively reeved around the additional traveling sheaves and crown sheaves in parallel with the cables of first and second power transmission means, respectively, and being reeved in common therewith around the first and second equalizing means, respectively.

* * * * *

UNITED STATES PATENT AND TRADEMARK OFFICE

CERTIFICATE OF CORRECTION

PATENT NO. : 4,128,229

DATED : December 5, 1978

INVENTOR(S) : Thomas L. Elliston

It is certified that error appears in the above-identified patent and that said Letters Patent are hereby corrected as shown below:

Column 2, line 31, after "to" delete --a--.

Column 3, line 22, after "deep" insert --ocean--.

Column 4, line 33, "coupld" should be --coupled--.

Column 4, line 37, after "array" "a" should be --of--.

Column 5, line 31, after "66" insert --being--.

Column 5, line 62, after "rig" delete --.--.

Column 7, line 49, after "portions" insert --disposed--.

Column 7, line 66, after "direction", first occurrence, insert -- opposite --.

Column 8, line 52, "wherin" should be --wherein--.

Column 9, line 22, "lateraly" should be --laterally--.

Column 9, line 23, "aroung" should be --around--.

UNITED STATES PATENT AND TRADEMARK OFFICE

CERTIFICATE OF CORRECTION

PATENT NO. : 4,128,229

DATED : December 5, 1978

INVENTOR(S) : Thomas L. Elliston

It is certified that error appears in the above-identified patent and that said Letters Patent are hereby corrected as shown below:

Column 9, line 29, after "thereafter" insert --being--.

Column 11, line 24, "sheve" should be --sheave--.

Column 12, line 56, after "first" insert --mast--.

Signed and Sealed this

*Third* Day of *March 1981*

[SEAL]

*Attest:*

RENE D. TEGTMEYER

*Attesting Officer*

*Acting Commissioner of Patents and Trademarks*